US006059318A

United States Patent [19]

Estep et al.

[11] Patent Number: 6,059,318

[45] Date of Patent: May 9, 2000

[54] LATERAL ENTRY REMOTELY OPERATED COUPLING SYSTEM

[75] Inventors: Tom Edward Estep, Chesterfield, Va.; Ronald P. Hoffman, Glen Mills; James R. Hunter, Chadds Ford, both of Pa.; Jean Joseph Muller, Kopstal; Germain Schilz, Mondercange, both of Luxembourg; Carl E. Vorhees, Newark, Del.; James M. Wiggins, Midlothian, Va.; Jean Francois Woll, Bettembourg, Luxembourg

[73] Assignee: E. I. du Pont de Nemours and Company, Wilmington, Del.

[21] Appl. No.: 08/848,355

[22] Filed: Apr. 21, 1997

Related U.S. Application Data

[60] Provisional application No. 60/017,073, Apr. 30, 1996.

[51] Int. Cl.[7] ..... F16L 19/02

[52] U.S. Cl. ..... 285/18; 285/325; 285/920; 285/326; 285/24; 285/93; 285/27; 425/382.2

[58] Field of Search ..... 285/18, 24, 27, 285/93, 124.1, 325, 326, 920; 264/22, 24; 425/382.2, 224, 231, 456, 373

[56] References Cited

U.S. PATENT DOCUMENTS

| | | | |
|---|---|---|---|
| 154,536 | 8/1874 | Wolf | 285/325 |
| 823,346 | 6/1906 | Maxwell | 285/325 |
| 942,047 | 12/1909 | Atkinson | 285/325 |
| 959,854 | 5/1910 | Grierson | 285/325 |
| 2,761,703 | 9/1956 | Olwin | 285/326 |
| 3,365,215 | 1/1968 | Arzt et al. | 285/24 |
| 3,851,023 | 11/1974 | Brethauer et al. | 264/24 |
| 3,860,369 | 1/1975 | Brethauer et al. | 425/3 |
| 4,011,532 | 3/1977 | Williams et al. | 333/98 |
| 4,043,707 | 8/1977 | Heumann et al. | 285/325 |
| 4,070,045 | 1/1978 | Colter et al. | 285/325 |
| 4,327,942 | 5/1982 | Abbes et al. | 285/325 |
| 5,173,242 | 12/1992 | Luehrsen et al. | 266/44 |

FOREIGN PATENT DOCUMENTS

| | | | |
|---|---|---|---|
| 683489 | 6/1930 | France . | |
| 3731936 | 6/1989 | Germany . | |
| 52155216 | 3/1988 | Japan . | |
| 62-210037 | 3/1988 | Japan . | |
| 345984 | 3/1931 | United Kingdom | 285/325 |
| 813407 | 5/1959 | United Kingdom | 285/326 |

*Primary Examiner*—Eric K. Nicholson

[57] ABSTRACT

This invention relates to a coupling system for connecting one or more fluid conduits wherein the system is adapted for lateral entry of one pipe or conduit to the other. The coupling system is also suited for making a connection in an environment which is relatively inaccessible to personnel and may be remotely operated.

15 Claims, 7 Drawing Sheets

LATERAL ENTRY REMOTELY OPERATED COUPLING SYSTEM

RELATED APPLICATION

This application claims the benefit of U.S. Provisional Application No. 60/017,073, filed on Apr. 30, 1996.

FIELD OF THE INVENTION

This invention relates to pipe coupling arrangements and especially to pipe coupling arrangements which are relatively inaccessible or are in environments that are hazardous to human personnel.

BACKGROUND OF THE INVENTION

In the process of manufacturing Tyvek® spun bonded olefin, a spin solution is carried from a solutioning system to a plurality of spinpacks in a spin cell. Unfortunately, it is quite common that a spinpack becomes fouled during the manufacturing process and needs to be shut down and replaced. Although the manufacturing process has been engineered such that production can continue while a single spinpack is not operating, the spinpack is positioned within a spin cell that is closed to prevent or minimize the release of the spin agent.

Presently, the spin solution is a combination of olefin polymer and a CFC spin agent and access to the spinpack is provided from above the spin cell with a number of precautions and procedures to minimize the release of vaporized CFC spin agent which is substantially heavier than air. However, E. I. du Pont de Nemours and Company (DuPont) has developed a new process for manufacturing Tyvek® spun bonded olefin in light of the need to stop using the CFC spin agent because of the belief that such CFC's are ozone depleters. In the new process, pentane will be used as the spin agent and thus many changes to the process are necessary in light of the flammability of pentane that did not exist with the CFC spin agent. One consideration is that access by human personnel to the spin cell for changing spinpacks will be more limited.

Accordingly, it is an object of the present invention to provide an arrangement and process for changing spinpacks in a spin cell which may be accomplished with minimal exposure of personnel to the spin cell environment.

It is a further object of the present invention to provide a remotely operated coupling system for disconnecting a spinpack and connecting a new spinpack into a spin position.

It should be noted that there are prior art systems for making connections of pipes remotely. However, such prior art systems are designed to include configured surfaces which must be generally axially aligned prior to bringing one pipe into contact with the second pipe. Thus, the one pipe is first moved into a position where its axis is generally co-extensive with the axis of the second pipe and then the first pipe is conveyed axially toward the second pipe. Such an arrangement may be termed an axial entry coupling system. There are instances when remote operation is desirable but axial entry is not practical. For example, in the situation where the spinpacks are being switched in and out, each spinpack has to fit down through a portal or hatch into the spin cell in a manner which seals with the spin cell while making numerous other fluid and electrical connections. The sealing arrangement restricts the freedom of movement of the spinpack, particularly as the spinpack approaches its operational position, at the base of the portal. It would require a complicated arrangement to make an axial entry connection to a pipe oriented laterally to the portal.

As mentioned above, there are remotely operated connectors which require the two step approach of axial alignment and then axial entry that is unsuitable for certain applications. Specifically, a remotely operated connector offered in the Grayloc® product catalog by Gray Tool Company (a subsidiary of Combustion Engineering) shows a system for connecting two pipe ends with specially designed mating surfaces. The system has a clamping mechanism with two pivoting clamps each having an arcuate, wedge shaped surface that pivots toward one another to engage a corresponding surface on the pipe flange. With this design, the two pipe flanges must first be aligned so that the two pipes are generally coaxial. Then the pipes are brought together axially so that the wedge surfaces on the pipe flange may pass between the pivoting clamps and engage a conical seal. This arrangement would not accommodate a lateral entry of the pipe.

The term "lateral entry" or "lateral approach" are each intended to mean an arrangement where the end of one pipe is brought to the end of another pipe for the purposes of making a connection between the two pipes such that the approach of the one pipe is from a direction which is lateral with respect to the axes of the two pipes. In the perfect sense of "lateral entry", the two pipes have parallel axes and the direction of approach is perpendicular to the axes of each of the pipes. It should be noted that the pertinent portion of the pipes at which to consider the axis of each pipe is at the end that is to be connected to the other pipe. It should also be recognized that one pipe need not be fixed or stationary, but that both pipes may be in motion toward a position for connection and such direction of motion need not be primarily in the lateral direction. It is the relative motion of the pipes to one another that provides for lateral approach.

Accordingly, it is a further object of the present invention to provide a pipe coupling arrangement that provides for lateral entry of one pipe to the other.

SUMMARY OF THE INVENTION

The above and other objects of the invention are accomplished by the provision of a coupling system which comprises a wear plate having at least one opening therein arranged in fluid communication with a first pipe and a flange also having at least one opening therein arranged in fluid communication with a second pipe. The system further includes a locator device which is arranged not to impede lateral approach of the flange with the wear plate, for locating the flange relative to the wear plate such that the opening in the wear plate is generally aligned with the opening in the flange as the flange and the wear plate are brought together by lateral approach. A locking mechanism is arranged not to impede lateral approach of the flange with the wear plate so as to lock the flange and the wear plate together while the openings in the flange and wear plate are generally aligned and the first and second pipes are thereby in fluid communication with one another.

The invention may also be described as a process for attaching one pipe to another comprising the steps of moving one pipe relative to the other such that a flange at the end of one pipe laterally approaches the wear plate of the other pipe. Then the flange plate is located relative to the wear plate with a locator arrangement such that the pipes are proximate one another in an arrangement suitable for connecting one to the other, and then the flange plate is locked to the wear plate by a locking arrangement thereby attaching the pipes together.

BRIEF DESCRIPTION OF THE DRAWINGS

The invention will be more easily understood by a detailed description and explanation including drawings which particularly illustrate the invention. Accordingly, drawings which are suited for explaining the invention are attached herewith; however, it should be understood that such drawings are for explanation purposes only and are not necessarily to scale. The drawings are briefly described as follows.

DETAILED DESCRIPTION OF THE PREFERRED EMBODIMENT

Figure 1:
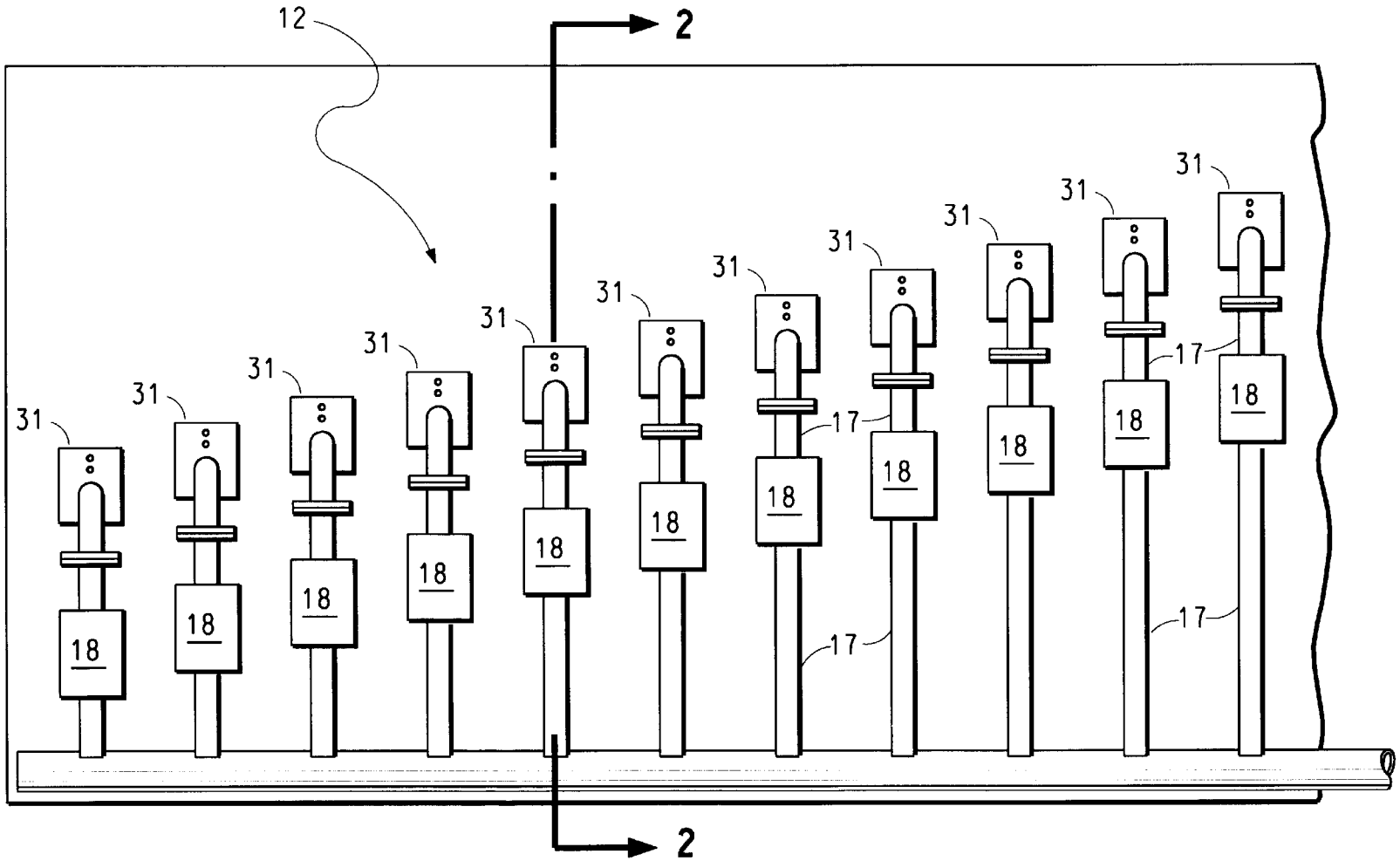
FIG. 1 is a generally schematic top view of the spin cell for making flash spun Tyvek® spun bonded olefin particularly illustrating the positions at which the spinpacks are mounted therein.

Focusing specifically on the drawings, the invention will now be described in greater detail so as to explain its structure and function and also to explain its contribution to the art and application in industry. In FIG. 1, there is shown a closed spin cell, generally indicated by the number 12, which is particularly suited for flash spinning fiber and laying it down in sheet form. The spin cell 12 is closed to maintain a generally constant spinning environment and also to contain the vaporized spin agent which, under the new technology, is a flammable hydrocarbon. The space immediately outside the spin cell 12, generally called the spin cell access area or space, is preferably readily accessible to operations and maintenance personnel. The spin cell access space preferably has ordinary atmospheric air provided by conventional industrial HVAC equipment to provide a safe and comfortable work environment. Thus, while there must be access between the spin cell 12 and the spin cell access space, the access must be controlled through a sealed arrangement to minimize the cross mixing of the two atmospheres.

Figure 2:
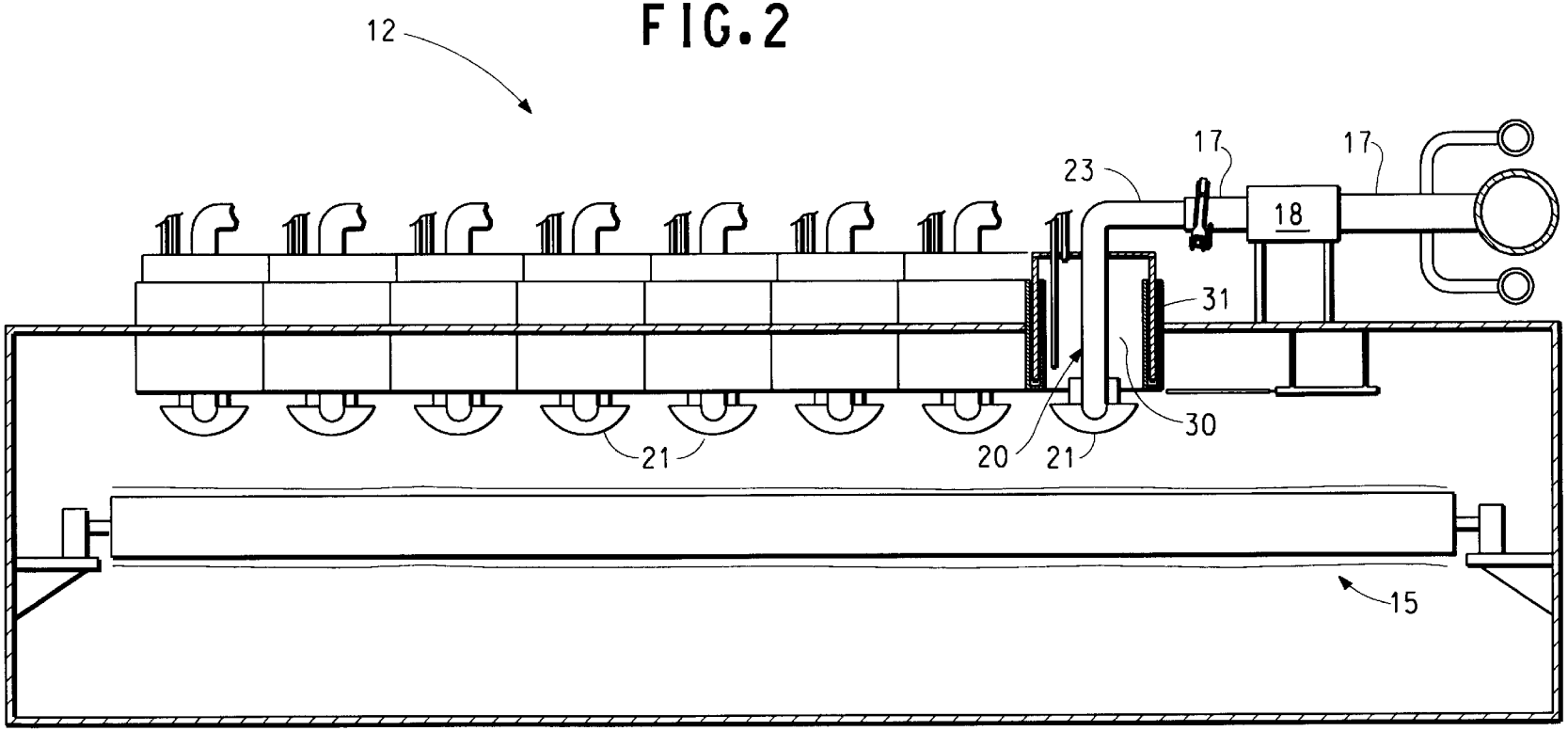
FIG. 2 is a cross sectional end view of the spin cell taken along Line 2—2 in FIG. 1.

Referring now to FIG. 2, the flash spun sheet material is created within the spin cell 12 by flash spinning a fiber from a polymer solution at a number of spinpacks 20 and casting the fiber down onto a conveyor 15 to overlap in the form of a web or sheet approximately ten to twelve feet in width. The polymer solution is provided to each spin pack 20 by a solution supply line 17 having a solution control valve 18. The polymer passes through a downleg conduit 23 in the spinpack 20 where it is spun into fiber. The web or sheet is carried out of the spin cell 12 through a suitable sealed exit (not shown). The fundamental operation of the spinpacks 20 is generally as described in other disclosures related to the manufacture of Tyvek® spun bonded olefin such as U.S. Pat. No. 3,851,023 to Brethauer et al., U.S. Pat. No. 3,860,369 to Brethauer et al., and U.S. Patent U.S. Pat. No. 5,558,830 which was granted on U.S. patent application Ser. No. 08/348,364 and U.S. Pat. No. 5,643,524, which was granted on U.S. patent application Ser. No. 08/460,524 which was a continuation of U.S. patent application Ser. No. 08/367,367, now abandoned , all of which are owned by E. I. du Pont de Nemours and Company and incorporated herein by reference.

Figure 3:
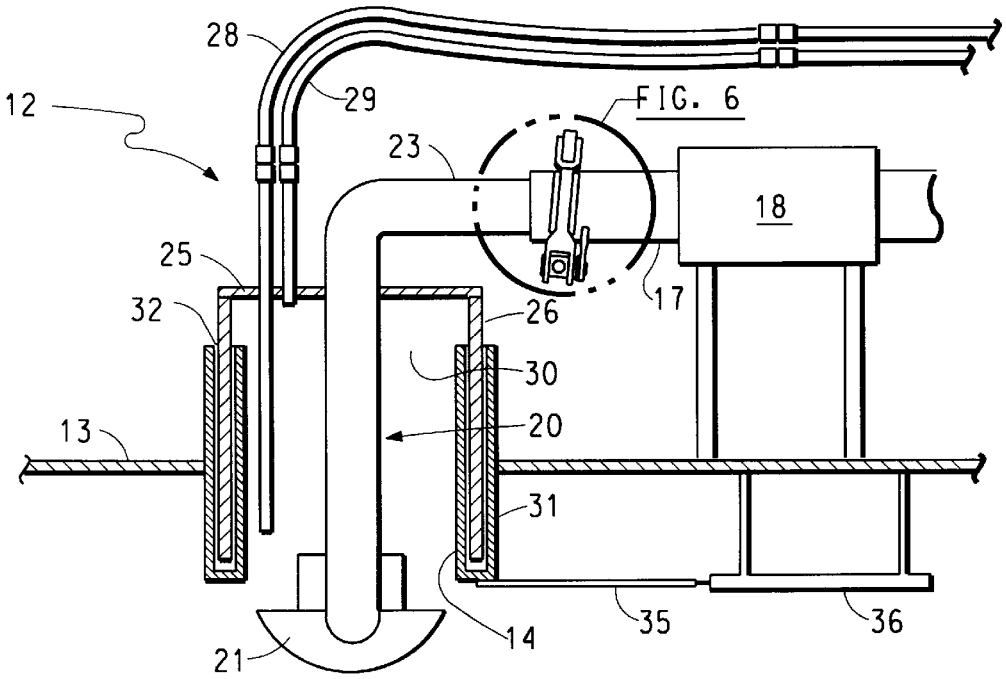
FIG. 3 is an enlarged fragmentary cross sectional view illustrating a single spinpack in its operational, downwardly extended position.
Figure 4:
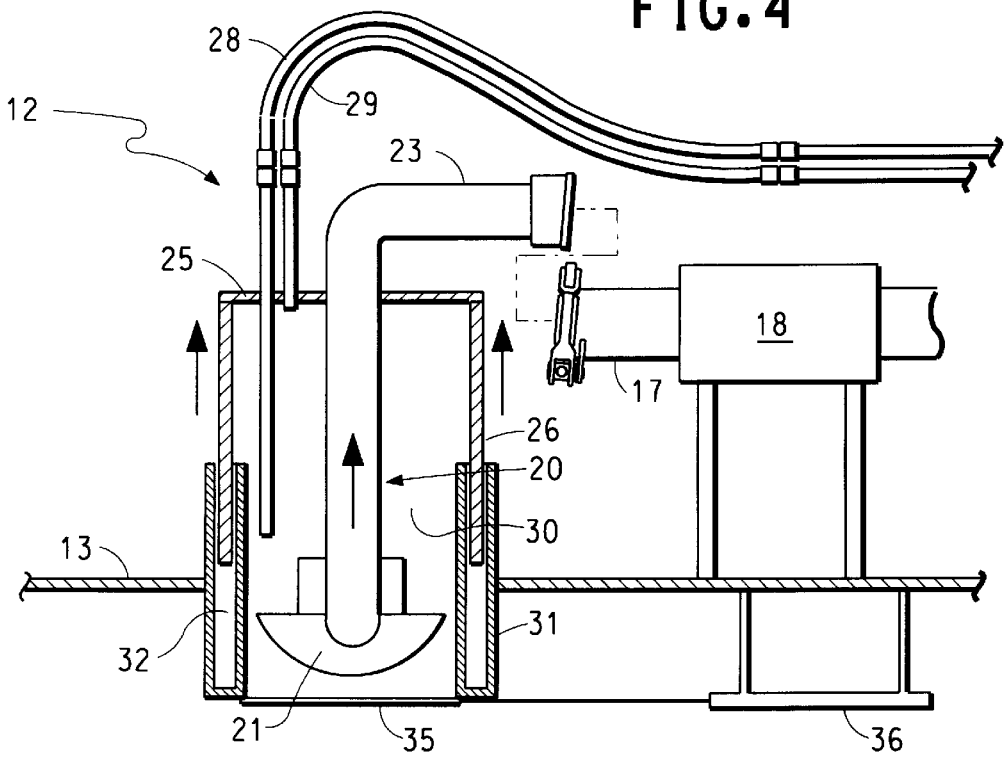
FIG. 4 is a fragmentary cross sectional view similar to FIG. 3 illustrating a single spinpack in its transitional position.
Figure 5:
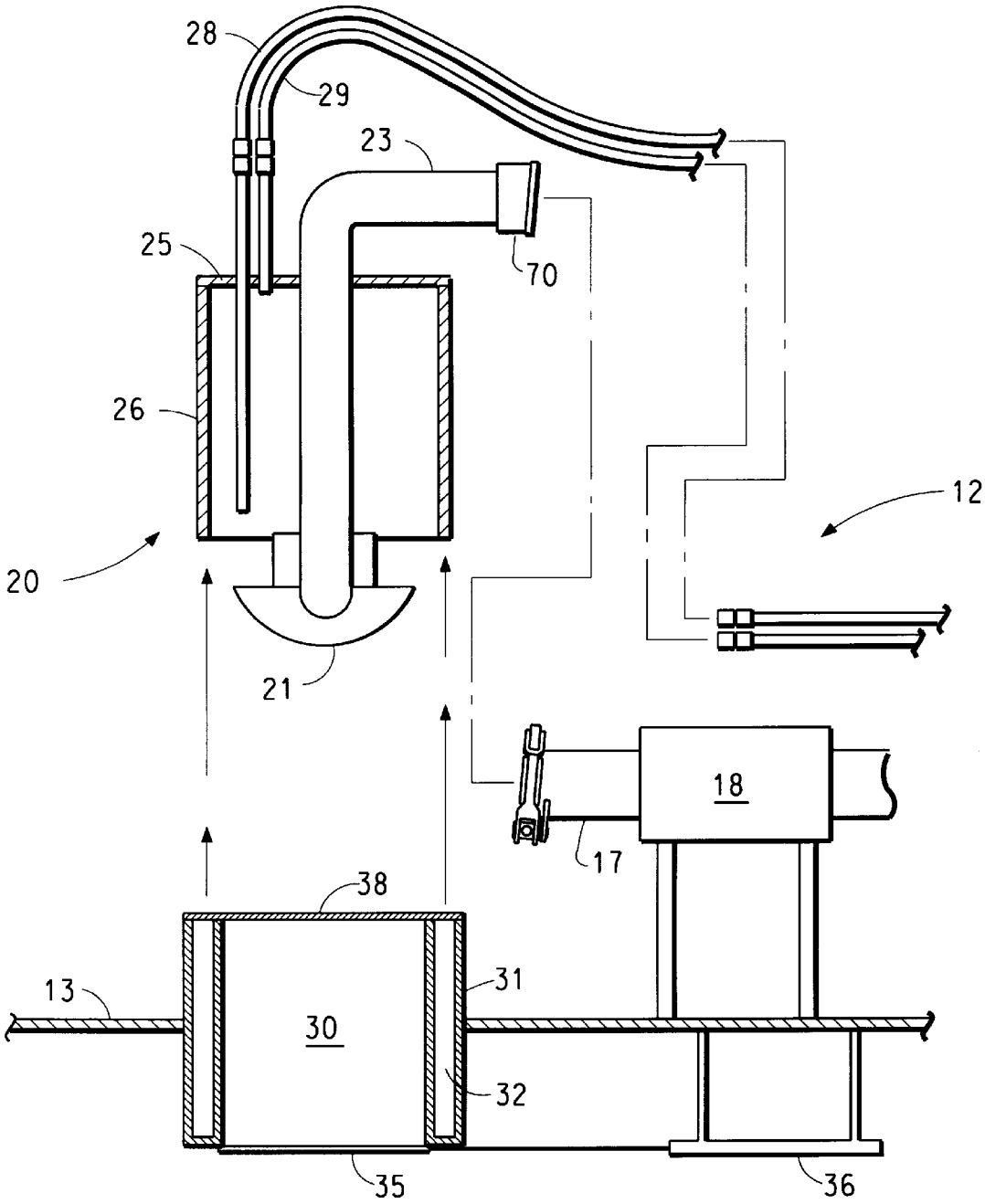
FIG. 5 is a fragmentary cross sectional view similar to FIG. 3 with the spinpack fully removed from the portal.

As noted above, the spinpacks 20 routinely become fouled and must be shut down for replacement. The spinpacks 20 are thus designed for being removed from the spin cell 12 during operation which means that the switchout or replacement operation is performed while the spin cell 12 is maintained closed and sealed. The step wise process of removing a spinpack 20 and replacing it with a rebuilt or reconditioned spinpack is illustrated in FIGS. 3, 4 and 5. Beginning with FIG. 3, a spinpack 20 is illustrated in its operational position with the spin head (not shown) and diffuser 21 extending into the main space in the spin cell 12 by projecting below the upper wall 13. The upper wall 13 includes a number of openings 14 therein at which the portals 30 are formed.

Each portal 30 includes a peripheral wall 31 that surrounds the opening 14 and is sealed to the upper wall 13 by welding or other sealing arrangement such that each portal 30 forms an open ended (top and bottom) space that is roughly one meter by one meter by one meter. The peripheral wall 31 of the portal 30 is actually formed of a double wall or a pair of spaced concentric walls to form a deep and narrow open top seal channel 32 extending fully around the portal 30 like a moat. The spinpacks 20 each include a spinpack cover 25 and a spinpack skirt 26 projecting down from the periphery of the spinpack cover 25 to fit down into the seal channel 32. The spinpack skirt 26 preferably extends downwardly from the spinpack cover 25 about the depth of the seal channel 32. The weight of the spinpack 20 is preferably carried by the spinpack cover 25 on the top of the peripheral wall 31 although in an alternative arrangement, the spinpack skirt 26 may rest at the bottom of the seal channel 32 as shown in FIG. 3. The seal channel 32 is substantially filled with water or other suitable liquid for forming a seal, in conjunction with the spinpack skirt 26 extending down into the seal channel 32, between the portal 30 and the spin cell access space.

Each spinpack 20 is provided with numerous connections which, for purposes of clarity of the drawing figures, are not all shown. The connections are to provide fluids to the spinpack 20 for spinning, to electrically or otherwise provide data regarding operating conditions of the spinpack 20 and spin cell 12, and also to provide control signals to control and adjust the operation of the spinpack 20. As already noted, polymer solution is provided through a number of solution supply lines 17, having a solution control valve 18 in each line, to each of the spinpacks 20. The connection of the spinpacks 20 to the solution supply lines 17 will be explained in detail below and preferably includes the feature of providing other fluids to the spinpack as will also be explained. In addition, the spinpacks 20 are each provided with purge gas, such as nitrogen, through a purge gas conduit 28 and a purge return conduit 29 for venting gases from the enclosed portal 30 to a flare or other suitable location. As will be described below, the purge gas is provided while the spinpack 20 is in the transitional position as illustrated in FIG. 4. In the first preferred embodiment, the conduits 28 and 29 are connected through the spinpack cover 25. In a second preferred embodiment, the conduits may alternatively be connected through the peripheral wall 31 below the seal channel 32, thus avoiding the need to connect and disconnect the same as a spinpack is being replaced.

The operational position of each spinpack 20 has now been described, the description will now move to the transitional position of the spinpack 20. In FIG. 4, the spinpack 20 has been shutdown and lifted up in the portal 30 to an intermediate or transitional position by a suitable lift or crane (not shown). Most of the connections, particularly the connection for the polymer solution have been separated or disconnected. Notably, the purge gas conduit 28 and purge return conduit 29 remain connected or the connection of the conduits 28 and 29 are connected at this stage. With the diffuser 21 withdrawn up into the portal 30 generally above the upper wall 13, a slide gate 35 is moved into a position below the portal 30 to isolate the portal 30 from the main space in the spin cell 12. The slide gate 35 is arranged under the upper wall 13 of the spin cell 12 adjacent the base of the portal 30 for closing the bottom thereof. A slide gate drive 36 is arranged to move the slide gate back and forth along the bottom side of the upper wall 13 to clear the bottom of the portal 30 or to close and seal the base of the portal 30. In FIG. 3, the slide gate 35 is clear of the portal 30 so as to be in the open position allowing the spinpack 20 to be fully lowered into its operational position. In FIG. 4, the portal is isolated from both the spin cell access space and the spin cell 12.

Immediately after the slide gate 35 is closed, the portal has an atmosphere which is essentially the same atmosphere as the spin cell 12. Such atmosphere comprises a significant concentration of the flammable hydrocarbon vapors from the spin agent. Thus, as noted above, it is important that the atmosphere in the portal 30 remain isolated from the spin cell access space. The spinpack skirt 26, while higher in the seal channel 32, is sized in conjunction with the size of the portal 30 and the size of the seal channel 32 so as to project below the surface of the water in the seal channel 32 and to maintain its seal while the spinpack 20 is in its transitional position. Thus, the transitional position is where the spinpack 20 is high enough in the portal to close the slide gate 35 (and the slide gate 35 is indeed closed) but not so high that the spinpack skirt 26 is out of the water in the seal channel 32. While the portal 30 is isolated and the spinpack 20 is in its transitional position, nitrogen or other inert gas is directed through a suitable valve into the purge gas conduit 28 to carry the atmosphere within the portal 30 through the purge return conduit 29, and suitable valving therefore, to purge the portal 30 of any flammable or other hazardous vapors or chemicals.

Once the portal 30 has been suitably purged, the remaining connections of the conduits 28 and 29 are disconnected and the spinpack 20 is removed from the portal 30 as shown in FIG. 5. A cap 38 may be provided over the portal 30 while the portal 30 is unoccupied. The explanation of the removal process of a spinpack 20 is now complete. Once a spinpack 20 is removed, however, it is generally desired that it be replaced with another spinpack 20 that can be put into service and thereby restore full spinning capacity.

The process of replacing a spinpack is essentially the reverse of the process for removing a spinpack 20. The replacement spinpack 20 is positioned over the portal 30 (with the cap 38 removed) and lowered until the lower extremity of the spinpack skirt 26 enters the water in the seal channel 32. In this position, the portal 30 will have an atmosphere from the spin cell access area which would include some oxygen content. The purge gas and purge return conduits 28 and 29 are reconnected so as to purge the portal 30 while the spinpack 20 is again in the transitional position as shown in FIG. 4. Once the portal 30 is suitably purged, the slide gate 35 is opened by the slide gate drive 36 and the spinpack 20 is lowered until the spinpack cover 25 rests on top of the peripheral wall 31 or in the alternative arrangement, the base of the spinpack skirt 26 rests at the bottom of the seal channel 32 and the connection between the spinpack 20 and the solution supply line 17 is aligned. Once, the spinpack 20 is in its operational position, the remainder of the connections are made, other checks and inspections are completed, and then the spinpack 20 is put into operation in the operating spin cell 12.

It should be noted that the seal channel 32 and spinpack skirt 26 will allow for some lateral and angular adjustment of the spinpack 20 relative to the spin cell 12; however, the spinpack 20 is moved almost exclusively in the vertical direction from the transitional position (FIG. 4) to the operational position (FIG. 3). The solution supply line 17 extends horizontally to the spinpack 20. As discussed above, pipe connections are known and available if the axis of the solution line were vertical so that the connection could be formed as the spinpack is lowered from the transitional position to the operational position. However, such an arrangement would require re-routing piping in a crowded space, plus add at least two additional bends in the piping. By the present invention, a simple and reliable coupling arrangement has been conceived and designed to provide the connection with a lateral entry or approach of the spinpack to the solution supply line 17 as desired.

Figure 6:
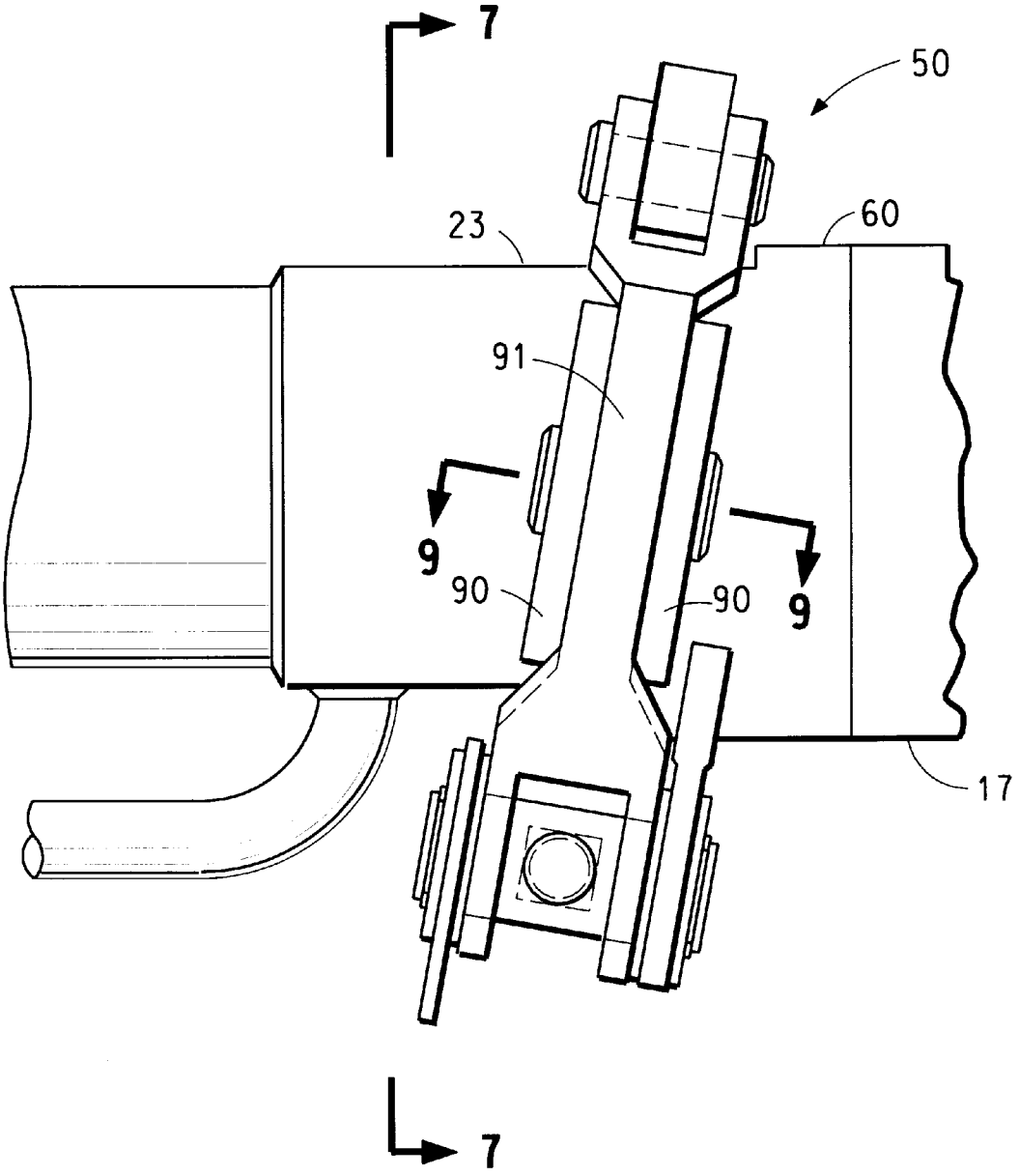
FIG. 6 is an enlarged fragmentary side view of the coupling system as indicated by Circle 6 in FIG. 3.
Figure 7:
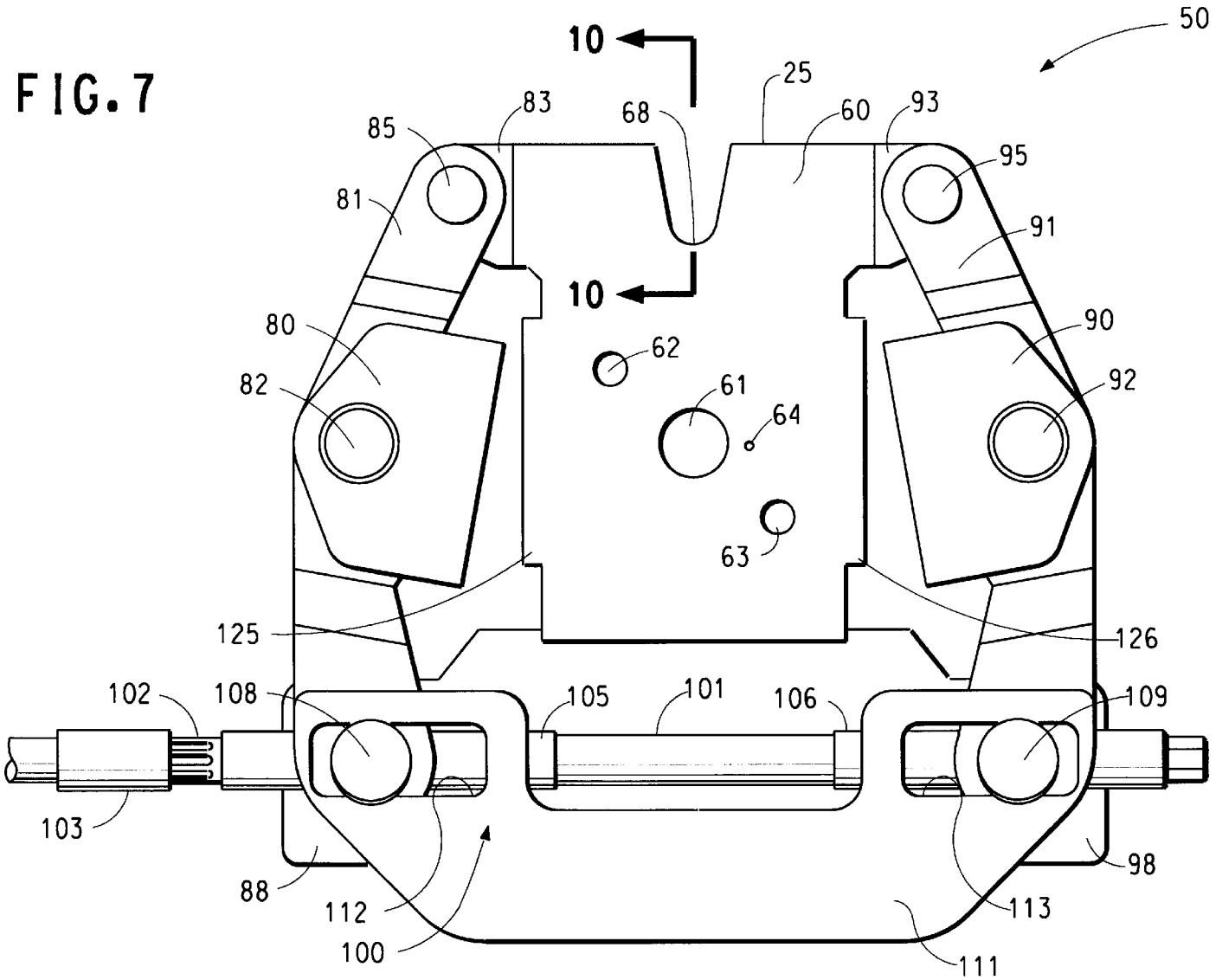
FIG. 7 is a front view of the wear plate assembly which is a portion of the coupling system illustrated in FIG. 6 with the spinpack removed for clarity.
Figure 8:
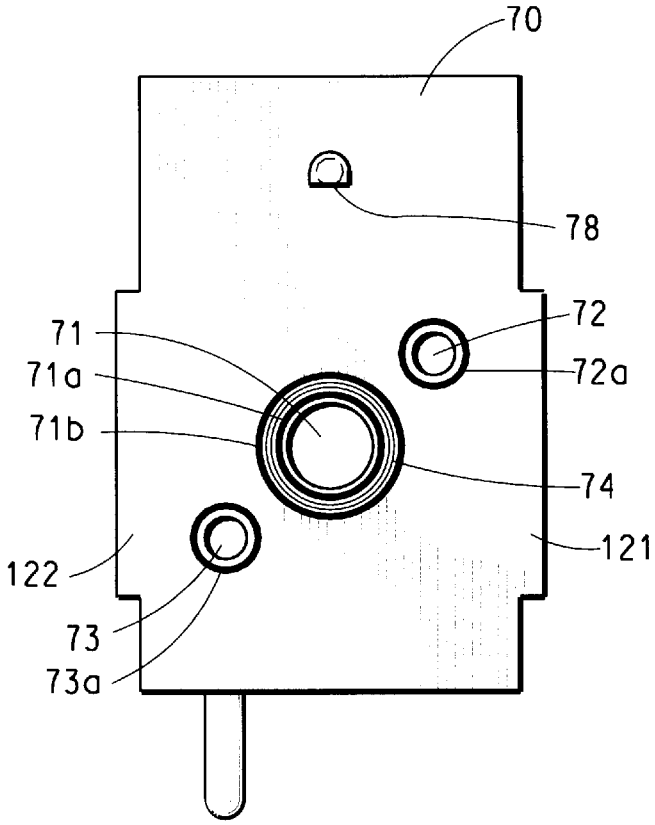
FIG. 8 is a front view of the pack flange of the spinpack which is a part of the coupling system illustrated in FIG. 6 and the complementary portion to the wear plate assembly illustrated in FIG. 7.

Referring now to FIGS. 6, 7 and 8, the coupling system, generally indicated by the reference number 50, is provided to connect the solution supply line 17 to the spinpack 20. The coupling system 50 is provided slightly above the portal 30 and away from where the technician would stand while installing or removing a spinpack 20. The area behind the portal 30 where the coupling system is located is rather unsuited for easy accessibility because of the piping, wiring and other equipment that is preferably located adjacent or connected with each spinpack 20. Thus, the coupling system 50 is preferably remotely operated.

The coupling system 50, comprises a wear plate 60 which remains generally fixed adjacent the back side of the portal 30, and a pack flange 70 which is part of the spinpack 20. The wear plate 60 is attached to the end of the supply line 17 and, as seen in FIG. 7, is generally planar and preferably machined smooth. In an alternative arrangement, the wearplate 60 could be attached directly to the solution valve 18, eliminating the section of solution supply line 17 shown between the valve 18 and the wearplate 60 in FIGS. 1 through 5. The wear plate 60 also includes several conduits extending therethrough. A solution conduit 61 is arranged in about the center of the wear plate 60 for carrying polymer solution into the spinpack 20. Slightly above and to one side of the polymer solution conduit 61 is a thermal fluid conduit 62 for carrying thermal fluid such as steam into the spinpack 20. Across the wear plate 60 from the thermal fluid conduit 62 is a thermal return conduit 63 for returning the spent thermal fluid, such as condensed steam, that has been circulated through a thermal jacket (not shown) in the spinpack 20. A small orifice 64 is provided to one side of the solution conduit 61 for providing inert gas into the coupling between the wear plate 60 and the pack flange 70. The purpose and function of the orifice 64 will be discussed later in this description. The wear plate 60 is preferably secured by bolts (not shown) to the solution supply line 17 so as to be removable to service the coupling 50 or the wear plate 60. It should be understood that the conduits 61, 62, 63 and 64 extend through the larger solution supply line 17; however, one or more of the conduits may alternatively be routed parallel to the solution supply line 17 to the wear plate 60 or may be supplied to the spinpack 20 through an entirely separate arrangement.

Turning now to FIGS. 5 and 8, the downleg conduit 23 acts as a mounting bracket and includes a pack flange 70 mounted at its distal end. The pack flange 70 includes passages which correspond to the conduits in the wear plate 60. In particular, the pack flange 70 includes a solution passage 71 in about the center thereof which corresponds to the solution conduit 61. Above and to one side of the solution passage 71 is a thermal fluid passage 72 which corresponds to the thermal fluid conduit 62. Across the pack flange 70 from the thermal fluid passage 72 is a thermal return passage 73 which generally corresponds with thermal return conduit 63. In addition to the passages in the pack flange 70, O-rings are provided about each of the passages to seal the connections between the respective passages in the pack flange 70 and conduits in the wear plate 60. Specifically, there is a first inner O-ring 71*a* encircling the opening of the solution passage 71 and a second outer concentric O-ring 71*b* spaced from and encircling the first inner O-ring 71*a*. Between the inner and outer O-rings is a channel 74 which functions with the small orifice 64 as will be described below. In a similar manner, O-rings 72*a* and 73*a* encircle the openings of the thermal fluid passage 72 and thermal fluid return passage 73, respectively. Thus, when pack flange 70 is brought flush to the wear plate 60, the O-rings 71*a*, 71*b*, 72*a* and 73*a* are compressed between the plates to seal the respective conduits to the respective passages.

As described above, the coupling system 50 is arranged to form a connection between the spinpack 20 as it is lowered into its operational position adjacent the horizontally oriented solution supply line 17. Thus, as has been noted several times before, the connection is formed by lateral entry or approach of the spinpack 20 with respect to the axes of both the solution passage 71 and the solution conduit 61. One apparent concern with trying to make such couplings, particularly in light of the desire to make the connection remotely, is to assure that the respective passages reliably become aligned with the respective conduits during the connection process. This is a particular concern when one understands that each of the spinpacks 20 is disassembled, cleaned up, parts replaced and reassembled after each use in the spin cell 12. As the spinpack 20 is reassembled, the downleg conduit 23 and the spinpack skirt 26 are each attached to the spinpack cover 25. Even with the best of efforts, it is unlikely that all the spinpacks 20 that may be used in all the various portals 30 will have the same precise arrangements between the spinpack skirt 26 and the pack flange 70. Moreover, one must appreciate that the spinpacks 20 and wear plates 60 will be subject to rough use both in the spin cell 12 and while being disassembled and rebuilt.

Thus, the first order of business for the coupling system 50 to form the connection is to verify that the spinpack 20 is adequately aligned with the portal 30 and that the pack flange 70 is aligned with the wear plate 60. The spinpack 20 is normally centered above the portal 30 by a crane or other suitable equipment at the beginning of the installation process. To assure such alignment is within acceptable limits, a pin 78 is provided on the pack flange 70 to be received in a notch 68 in the wear plate 60. The notch 68 is preferably configured with a "V" shape with inclined "walls" or "ramps" at the opposite sides thereof to "catch" the pin and direct the pack flange 70 into the desired alignment with the wear plate 60 as the spinpack 20 is lowered into its operational position. The notch may also be described as having opposite walls splayed out from the bottom of the notch called the notchbottom.

The non-mechanical seal between the spinpack skirt 26 and seal channel 32 is also suited to freely permit any necessary adjustments by the operator to correct the alignment in case the pin 78 is not quite falling into the notch 68. The notch 68 has an arcuate shape at the notchbottom, which is positioned to provide a relatively acceptable alignment of the pack flange 70 and the wear plate 60. A clearance is provided between the pin 78 and the notch 68, to allow the spinpack 20 to self-center, as required, when the coupling system clamp force is applied later. The sealing O-rings described above, are sufficiently large in diameter to properly seal the flange 70 to wear plate 60 anywhere within the clearance of the pin 78 to notch 68.

Figure 10:
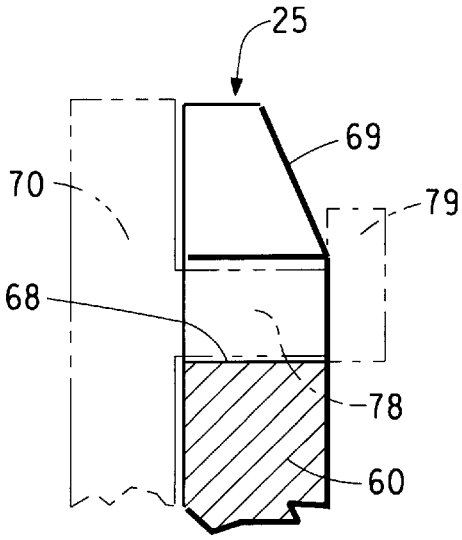
FIG. 10 is an enlarged cross section view of the coupling taken generally along the line 10—10 in FIG. 7.

The pin 78 also includes an oversized head 79 positioned at the distal end thereof. As best seen in FIG. 10, the wear plate 60 further includes a tapered back surface 69 forming a ramp at its upper portion. The tapered back surface 69 permits the oversize head 79 on the pin 78 to "catch" the wear plate 60 between the pack flange 70 and the head 79 to pull the pack flange 70 toward the wear plate 60, if the pack flange 70 is not close enough to contact the wear plate 60 on its own, as the spinpack is lowered into its operational position. To the extent that the pack flange 70 would be inclined to be spaced from the wear plate 60 when the spinpack is fully lowered into is operational position and resting on the spinpack cover 25 or in an alternative arrangement, on skirt 26, the head 79 and tapered back surface 69 cooperate to position the pack flange 70 close to the wear plate 60.

It is noted that the wear plate 60 and the pack flange 70 are preferably arranged at a slight incline relative to the vertical. The incline is preferably in the range of about three degrees to about 15 degrees although such incline need not exist at all or could be more exaggerated. The purpose of the slight incline is to allow the pack flange 70 to contact the wear plate 60, on its own, and slide down in contact with it as the spinpack 20 is lowered into position. It is even conceivable that the pack flanges and wear plates could have a negative angle such as a slight incline where the pack flange 70 is angled slightly upwardly. Such modifications are within the scope of one having ordinary skill once such persons are provided with an explanation of the present invention.

Turning now to the portion of the coupling system 50 that secures the pack flange 70 to the wear plate 60, reference is made again to FIG. 7. In FIG. 7, the coupling system 50 is illustrated with left and right clamps 80 and 90, respectively, wherein each is in its respective open position ready to receive the pack flange 70. The clamps 80 and 90 are carried by and hingedly secured to respective left and right clamp arms 81 and 91 by respective pins 82 and 92. The clamp arms 81 and 91 are themselves hinged at their upper ends to respective left and right upper lugs 83 and 93 of the wear plate 60 by left and right hinge pins 85 and 95. As such, the clamp arms 81 and 91 pivot about the respective pins 85 and 95 to bring the clamps 80 and 90 toward and away from the center of the wear plate 60. Movement of the clamp arms 81 and 91 is effected by an actuator system generally indicated by the number 100.

The actuator system 100 comprises a screw shaft 101 that includes two threaded portions 105 and 106 wherein the first threaded portion 105 has screw threads arranged in one direction and the second threaded portion 106 has screw threads arranged in the opposite direction. The first threaded portion 105 of the screw shaft 101 is associated with the left clamp arm 81 and the second threaded portion 106 of the screw shaft 101 is associated with the right clamp arm 91. Threaded onto the screw shaft 101 at the first threaded portion is a left threaded actuator pin 108. In a similar manner, a right threaded actuator pin 109 is threaded onto the second threaded portion 106 of the screw shaft 101. The respective threaded actuator pins 108 and 109 are adapted so as to move along the screw shaft 101 in opposite directions as the screw shaft 101 is rotated about its axis with respect to the threaded actuator pins 108 and 109.

The threaded actuator pins 108 and 109 are suitably connected to the lower portions of the respective left and right clamp arms 81 and 91 so as to rotate about the respective axes of the hinge pins 85 and 95. Preferably, the clamp arms 81 and 91 have a yoke type configuration at the lower end thereof with the respective actuator pin passing transversely through the spaced pair of ears of the yoke and the screw shaft 101 passing through the opening of the yoke and a medial portion of the respective actuator pin. In addition, the left and right actuator pins 108 and 109 are arranged to extend through slides (not shown) in respective left and right lower lugs 88 and 98. For additional stability of the actuator system 100, a tie plate 111 is provided on the opposite ends of the actuator pins from the left and right lower lugs 88 and 98 having respective left and right slides 112 and 113.

Figure 9:
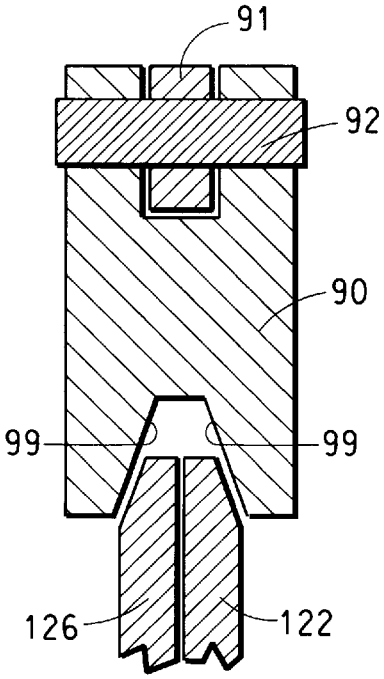
FIG. 9 is an enlarged fragmentary cross section view of the coupling taken generally along line 9—9 in FIG. 6.

Thus, under the action of the actuator system 100, the clamps 80 and 90 are pivoted about respective hinge pins 85 and 95 toward and away from one another. The actuator system 100 is operated by rotation of the screw shaft 101 by a motor (not shown), a hand wheel (not shown) or other suitable device through a coupling 103 attached to a splined portion 102 at the end of the screw shaft 101. The splined connection of the coupling 103 and splined portion 102 allows the screw shaft 101 to move along its axis (laterally in FIG. 7) which will provide advantages for the system 50 as will be explained below. As the clamps 80 and 90 move together, it is intended that the coupling of the pack flange 70 to the wear plate 60 become quite secure. The solution supply line 17 may be provided with suitable rigidity and strength to support the entire weight of a spinpack 20 under operational loads. However, it is preferred that the weight of the spinpacks 20 be supported by the spinpack cover 25 resting on the top edge of the peripheral wall 31. The peripheral wall 31 may include a flange to reinforce the top edge. Regardless of whether the coupling system 50 simply connects two pipes together or also provides the support for suspending the spinpack in position, the connection is preferably very tight. Thus, there would be zero or practically zero "play" between the wear plate 60 and the pack flange 70. Thus, as best seen in FIGS. 7 and 9, the clamps 80 and 90 are provided with left and right bevelled jaws 89 and 99 which have a "V" shaped or bevelled configuration to squeeze the pack flange 70 to the wear plate 60 for a very firm or tight connection.

In conjunction with the left and right bevelled jaws 89 and 99, the pack flange 70 includes left and right bevelled tabs 121 and 122 that engage left and right bevelled jaws 89 and 99, respectively (see FIG. 8). The reader should note that the tabs appear reversed in FIG. 9 since FIG. 9 is a reverse view compared to FIG. 8. The wear plate 60 similarly includes left and right bevelled tabs 125 and 126. As best seen in FIG. 9, the tabs are configured with only one bevelled surface along the "back" side thereof while the "front" surfaces are flat or flush. Thus, with the connection formed, the respective left bevelled tabs 121 and 125 are squeezed together in the left bevelled jaw 89 while the right bevelled tabs 122 and 126 are squeezed together in the right bevelled jaw 99. FIG. 9 shows the tabs and jaw just before they are squeezed together. The mechanical advantage of the screw threads pulling the lower ends of the clamp arms together makes for a very secure and tight connection.

As briefly described above, the screw shaft 101 is provided with the limited freedom to move along its axis or in other words it is not fixed in a central position at the base of the wear plate 60. Thus, the clamps 80 and 90 also move in tandem with the screw shaft 101. This freedom of movement for the clamps 80 and 90 and the screw shaft 101 provides an additional measure of reliability for having a secure connection between the pack flange 70 and the wear plate 60. In particular, the coupling system 50 better accommodates irregularities of the spinpack 20 or the pack flange 70. Thus, if a pack flange 70 were to have a slightly larger or thicker tab at one side versus the other, the clamps 80 and 90 would have the freedom, while pulling hard together, to balance the forces on both sides of the wear plate 60 and pack flange 70. In other words, while one clamp may come into contact with the tabs before the other clamp, the clamp that comes into contact with the tabs would stop moving and the screw shaft 101 would simply move toward the stopped clamp because the screw shaft can slide on the splined portion 102 as it continues to rotate. At the same time, the screw shaft 101 would be pulling the opposite clamp at double the normal rate because the screw shaft is moving both axially and rotationally. Once both clamps are in contact with the tabs, the forces on the tabs would increase at about the same rate. On the other hand, if the screw shaft 101 were not permitted to move axially, then the one clamp that contacts the tabs first would cause tension to be pulled on the screw shaft from the clamp to the mechanism that holds the screw shaft in place. This could possibly lead to the clamp becoming very tight, pinching its respective tabs together and providing substantial resistance on the rotation of the screw shaft while the other clamp is not equally as tight in pressing its respective tabs together. If the operator perceives that the clamp is tight, then the connection may be left in an arrangement where it has the increased possibility of failing. Since the connection between the pack flange 70 and the wear plate 60 is within the spin cell access space, any leak at the connection would put a substantial volume of flammable vapors into a space having oxygen. Clearly, it is preferable to have the screw shaft 101 free to move along its axis as described.

Another feature of the present invention that has been briefly described is the small orifice 64 and the channel 74. During operation, the polymer solution is carried through the solution conduit 61 into the solution passage 71. This polymer solution is at relatively high pressure and temperature for spinning into fiber. However, since it includes a flammable hydrocarbon, it is important that the connection between the pack flange 70 and the wear plate 60 be tight and the O-rings 71*a* and 71*b* keep the conduit and passage sealed. If one of the O-rings were to fail, it is preferred that the spinpack 20 be shut down. The channel 74 is positioned between the two concentric O-rings and the small orifice 64 is intended to be in fluid communication with the channel 74. Nitrogen, or other inert gas, is provided to small orifice 64 through a valve including a pressure sensor to sense the pressure in the channel 74. The pressure of the nitrogen is preferably maintained at some middle pressure which is much less than the pressure of the polymer solution and higher than the pressure in the spin cell access space. During operation, if the pressure sensor detects a change in the measured pressure, this would indicate that one of the O-rings has failed or is about to fail. More particularly, if the pressure goes up, one can deduce that the inner O-ring is about to fail because the high pressure solution is entering the channel 74. On the other hand if the pressure of the nitrogen drops, then one can deduce that the outer O-ring is failing because the nitrogen is leaking out of the channel 74 past the outer O-ring and into the spin cell access space. In either of these two failure modes, the flammable hydrocarbon has not escaped into the spin cell access area, but the redundancy of the two concentric O-rings no longer exists.

In an alternative aspect, the inert gas may also be used to check the O-rings before the solution is allowed to pass from the solution valve 18 to the spinpack 20. In this scenario, nitrogen is pumped into the channel 74 through the small orifice 64 at a fairly high pressure and maintained at the high pressure for a predetermined test period. If there is no pressure drop, the O-rings are acceptable for starting up the spinpack. However, if the pressure drops, then it is presumed that there is at least some kind of problem with at least one of the O-ring seals and the connection 20 should be checked before it is put into operation. Equipment for measuring pressure drop are assumed to be sufficiently well known to those skilled in such arts that one is not needed to be illustrated for a full explanation of the invention.

The foregoing description and drawings were intended to explain and describe the invention so as to contribute to the public base of knowledge. In exchange for this contribution of knowledge and understanding, exclusive rights are sought and should be respected. The scope of such exclusive rights should not be limited or narrowed in any way by the particular details and preferred arrangements that may have been shown in the drawings or described in the description. The scope of any patent rights granted on this application should be measured and determined by the claims that follow.

We claim:

1. A lateral entry coupling system for connecting two pipes such that fluid may be carried through one pipe and into the other, wherein the coupling system comprises:

a wear plate having at least one opening therein arranged in fluid communication with a first pipe;

a flange having at least one opening therein arranged in fluid communication with a second pipe;

locator means, arranged to permit lateral approach of said flange with said wear plate, for locating said flange relative to said wear plate such that said opening in said wear plate is generally aligned with said opening in said flange as said flange and said wear plate are brought together by lateral approach and comprising a pin associated with said flange and a notch associated with said wear plate such that said pin is received into said notch by lateral approach of the flange and wear plate, and wherein said notch includes opposite trough walls which converge at a notchbottom and splay outwards from said notchbottom and said pin is sized to be received in said notchbottom while said openings in each of said flange and wear plate are generally aligned, and, further wherein said pin comprises a base, a post projecting from said base and an enlarged head at the distal end of said post; and wherein said notchbottom has a longitudinal dimension which is comparable to the length of said post such that when said flange and wear plate are locked together that said post lies with a peripheral surface generally longitudinally along said notchbottom with said base near one end of said notchbottom and said enlarged head near the other; and further wherein said notch includes a ramped back surface for being engaged by said enlarged head such that as the flange and wear plate are brought together along a lateral approach, the pin is arranged to move into said notch and follow any of said trough walls or ramp wall to a nested position at said notchbottom with flange closely positioned adjacent said wear plate and with said openings in each of said flange and wear plate being generally aligned; and a locking mechanism arranged to permit lateral approach of said flange with said wear plate and to lock said flange and said wear plate together while said openings in said flange and wear plate are generally aligned and the first and second pipes are thereby in fluid communication with one another.

2. The coupling system according to claim 1, wherein said pin is attached to said flange and said notch is positioned on said wear plate.

3. The coupling system according to claim 1, wherein said locking mechanism comprises at least a pair of opposed clamps positioned on opposite sides of said wear plate to lock said flange to said wear plate.

4. The coupling system according to claim 3, wherein said wear plate includes tabs along its peripheral edges adjacent said clamps such that said clamps engage said wear plate tabs and, further wherein said flange also includes tabs at its peripheral edges for being engaged by said clamps, and wherein said tabs are configured to squeeze together as they are engaged by said clamps.

5. The coupling system according to claim 4, wherein said locking mechanism further comprises at least one lug and wherein each of said clamps comprise a clamp arm pivotally attached to said lug at one end thereof and attached to an actuator pin at the other so that motion of said actuator pin causes the clamp arm to pivot about said lug into and out of engagement with said tabs.

6. The coupling system according to claim 5, wherein said locking mechanism includes two spaced apart lugs positioned on either side of a lateral entry path for said flange to laterally approach said wear plate and each lug has a single clamp arm pivotally attached thereto.

7. The coupling system according to claim 6, further including a screw shaft having first and second screw thread portions formed in opposite direction to one another and wherein each of said actuator pins are each threadedly engaged by one of said screw thread portions and attached to its respective clamp arm so as not to permit rotation about the axis of said screw shaft, and wherein the opposite nature of the threaded screw portions provides that rotation of the screw shaft causes the actuator pins to move toward one another or away from one another, thereby causing the clamp arms to move toward and away from the tabs, and further wherein said clamp arms include clamp jaws having bevelled surfaces oriented to exert compression forces on the tabs of both the wear plate and the flange.

8. The coupling system according to claim 7, wherein said clamp jaws are pivot mounted to said clamp arms to adapt to the orientation of said tabs.

9. The coupling system according to claim 7, wherein a remotely operated motor rotates said screw shaft to open and close said clamps and said screw shaft is free to move axially limited by engagement of said jaws with said tabs.

10. The coupling system according to claim 1, wherein an O-ring seal is provided about the opening in one of the wear plate and flange such that said O-ring seal is compressed between said wear plate and flange to form a seal for the fluid passing between the pipes.

11. The coupling system according to claim 10, wherein a second larger O-ring is provided circumferentially about said first mentioned O-ring seal thereby forming an annular space therebetween when said pack flange is held against said wear plate, and the coupling system further comprises an orifice in said wear plate leading into said annular space to provide inert gas under pressure and pressure sensing means to sense a pressure change indicating a breach in one of the O-ring seals.

12. The coupling system according to claim 1, wherein said wear plate and said flange are plates oriented at an angle generally in the range of 80 to 85 degrees relative to the axes of the respective first and second pipes.

13. A system comprising a generally closed cell having at least one processing station for receiving replaceable equipment which is replaced while the cell remains closed, equipment in said processing station and a coupling system for mounting said equipment in said processing station, the coupling system comprising:

a supply manifold positioned above said generally closed cell and including a wear plate having openings therein for conduits to convey polymer solution, thermal fluid, and other fluids to and from the spinpack wherein said conduits are arranged generally horizontally and said wear plate is oriented in a generally vertical plane;

a mounting bracket secured to the spinpack for being coupled to the wear plate wherein the mounting bracket includes a pack flange having openings therein for fluid passages corresponding to said openings in said wear plate wherein the pack flange is also oriented generally vertically to be flush against said wear plate with the axis of each fluid conduit approximately aligned with the axis of each respective corresponding fluid passage;

a mounting pin on said mounting bracket for aligning said pack flange with said wear plate as the bracket is being connected with said fixed support;

a notch on said wear plate for receiving said mounting pin such that said notch is oriented to receive the mounting pin by a lateral approach of said pack flange to the wear plate from above said supply manifold and with respect to the axes of the fluid conduit and fluid passage; and a clamp for applying axial compression of said pack flange onto said wear plate.

14. A process for attaching one pipe to another wherein the process comprises the steps of:

moving one pipe relative to the other such that a flange plate at the end of one pipe laterally approaches a wear plate at the end of the other pipe and; locating the flange plate relative to the wear plate with a locating device associated with the flange plate engaging a corresponding locating device associated with the wear plate such that the pipes are generally aligned proximate one another in an arrangement suitable for connecting one to the other; and locking the flange plate to the wear plate by a actuating locking arrangement which urges the flange plate and wear plate together thereby attaching the pipes together, the process further including the steps of:

providing inner and outer ring seals arranged circumferentially about the solution passage such that an annular space is formed between the respective inner and outer ring seals;

providing inert gas into the annular space; and monitoring the pressure of the inert gas in the annular space to verify the integrity of the ring seals.

15. A process for removing a non-operating spinpack and installing a replacement spinpack in a generally closed spin cell while the spin cell continues in operation, the process comprising the steps of:

rotating a screw shaft having separate first and second threaded portions wherein the first portion has screw threads formed in the opposite direction relative to the screw threads at the second threaded portion to open opposite clamps holding a pack flange of a mounting bracket flush against a wear plate of a supply manifold;

lifting the non-operating spinpack so that the pack flange moves generally laterally away from the wear plate and out of the spin cell through a portal in the upper portion thereof;

lowering a replacement spinpack into the spin cell through the portal such that the pack flange of the replacement spinpack approaches the wear plate laterally until a mounting pin engages a "V" shaped notch generally aligning the pack flange with the wear plate as well as solution and thermal fluid conduits of the wear plate with respective passages in the pack flange; and rotating the screw shaft in the opposite direction to draw the opposite clamps together to exert axial compression forces on the pack flange against the wear plate to securely hold the spinpack in place.

* * * * *